US006558185B1

(12) United States Patent
Stockel et al.

(10) Patent No.: US 6,558,185 B1
(45) Date of Patent: May 6, 2003

(54) JUMPER CABLE PLUG

(75) Inventors: Michael J. Stockel, Fort Wayne, IN (US); Gregg E. Laukhuf, Bryan, OH (US)

(73) Assignee: Dekko Engineering, Inc., Kendallville, IN (US)

( * ) Notice: Subject to any disclaimer, the term of this patent is extended or adjusted under 35 U.S.C. 154(b) by 0 days.

(21) Appl. No.: 09/562,564

(22) Filed: May 2, 2000

(51) Int. Cl.[7] ..... H01R 13/58
(52) U.S. Cl. ..... 439/465
(58) Field of Search ..... 439/452, 465, 439/467, 487, 486, 601, 470

(56) References Cited

U.S. PATENT DOCUMENTS

| | | | | | |
|---|---|---|---|---|---|
| 1,454,858 | A | | 5/1923 | Price | |
| 4,343,528 | A | * | 8/1982 | Lucius et al. | 439/601 |
| 4,449,778 | A | | 5/1984 | Lane | 339/143 |
| 4,687,263 | A | | 8/1987 | Cosmos et al. | 439/108 |
| 4,875,875 | A | | 10/1989 | Archer et al. | 439/401 |
| 5,505,637 | A | | 4/1996 | Krämer et al. | 439/610 |
| 5,545,054 | A | | 8/1996 | Benes et al. | 439/467 |
| 5,967,830 | A | * | 10/1999 | Tsuji | 439/470 |
| 6,113,435 | A | * | 9/2000 | Anderson, Jr. et al. | 439/687 |

FOREIGN PATENT DOCUMENTS

| | | | |
|---|---|---|---|
| CA | 1 132 217 | 9/1982 | H01R/13/10 |
| DE | 37 37 501 A1 | 5/1989 | H01R/13/58 |

* cited by examiner

*Primary Examiner*—Neil Abrams
(74) *Attorney, Agent, or Firm*—Taylor & Aust, P.C.

(57) ABSTRACT

A plug assembly for data/communication/power line jumper cable assembly has a body formed of two releasably interconnecting body sections and a plug that is releasably connected to the two interconnection body sections. Each interconnecting body section includes projections usable as threads on an inside surface to positively retain the plug assembly to the jumper conduit of the jumper cable assembly. A hook and slot system on respective interconnection sections creates a releasable interlocking fit therebetween.

16 Claims, 2 Drawing Sheets

JUMPER CABLE PLUG

BACKGROUND OF THE INVENTION

1. Field of the Invention

The present invention relates to terminating plugs or connectors for electrical jumper cables for data/communications/power lines and, more particularly, to a modular terminating plug assembly having a jumper cable retainer.

2. Description of the Related Art

Jumper cables for electrical wiring, lines and the like having terminating plugs or connectors at terminating ends thereof are used in a variety of applications. One such application is in office furniture and particularly to modular office furniture wherein the modular office furniture consists of panels, shelves, tables, cabinets, and other accessories to form various layouts of space and area. Another application is for delineating a workplace or office area. In both instances and others, electrical power, communications, data and other types of conductors/lines and the like need to be supplied.

No matter what the style of office or office furniture, such electrical power, communications, data, other types of lines and the like, need to be supplied to various points, usually variable positions in the workspace. This is accomplished by the use of outlets and the like for the various lines in the panels and accessories for office space, and in the office furniture itself. It is necessary, however, to connect the various receptacles to other receptacles and/or distribution conduits/cables. Interconnection between the various receptacles is typically accomplished by use of jumper cable assemblies.

The jumper cable assembly typically includes a conduit carrying the various lines and terminates in a plug and/or receptacle on either end. The conduit and thus the lines may be any practical length. The plug and/or receptacle is adapted to receive into a mating receptacle/plug and provide communication between the lines of the jumper cable and the receptacles.

Prior art plugs are difficult to manufacture and use. As well the retention means between the plug and the jumper cable requires appreciable assembly time.

SUMMARY OF THE INVENTION

The present invention provides a jumper cable and plug assembly.

In one form, the plug assembly comprises a body having a conduit reception area and a plug reception area defined by a first body section and a second body section. The first body section has a first given shape defining a first portion of the conduit reception area and a first portion of the plug reception area. The first portion of said conduit reception area including first tabs on an interior surface. The second body section has a second given shape defining a second portion of the conduit reception area and a second portion of the plug reception area. The second portion of the conduit reception area includes second tabs on an interior surface. The first given shape complementarily corresponding to said second given shape. A plug is adapted to be received by the plug reception area of the body and provide communication with a mating receptacle.

In another form, the present invention is a plug body for a jumper cable assembly. The plug body comprises a first body portion and a second body portion adapted to be coupled to the first body portion and together therewith defining a jumper cable reception end and a plug reception end. The first body portion is defined by a shell having a first section of the jumper cable reception end, a first section of the plug reception end, and first connection means on the first section of the jumper cable reception end. The second body portion is defined by a shell having a second section of the jumper cable reception end, a second section of the plug reception end, and second connection means on the second section of the jumper cable reception end and adapted to connect with the first connection means of the first body portion.

In accordance with one aspect, the first connection means comprises hooked tabs and the second connection means comprises slots. In accordance with another aspect of the present invention, the first body portion includes third connection means on the first section of the plug cable reception end, and the second body portion includes fourth connection means on the second section of the plug cable reception end. The third and fourth connection means are adapted to couple with mating connection means of a plug receivable thereon. In accordance with yet another aspect of the present invention, the first body portion includes first threads on an inside surface of the corresponding shell within the first section of the jumper cable reception end, and the second body portion includes second threads on an inside surface of the corresponding shell within the second section of the jumper cable reception end.

An advantage of the present invention is that it is easily assembled.

Another advantage of the present invention provides a positive retention of the plug assembly to the jumper conduit.

Yet another advantage is that the present invention is easily fabricated.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
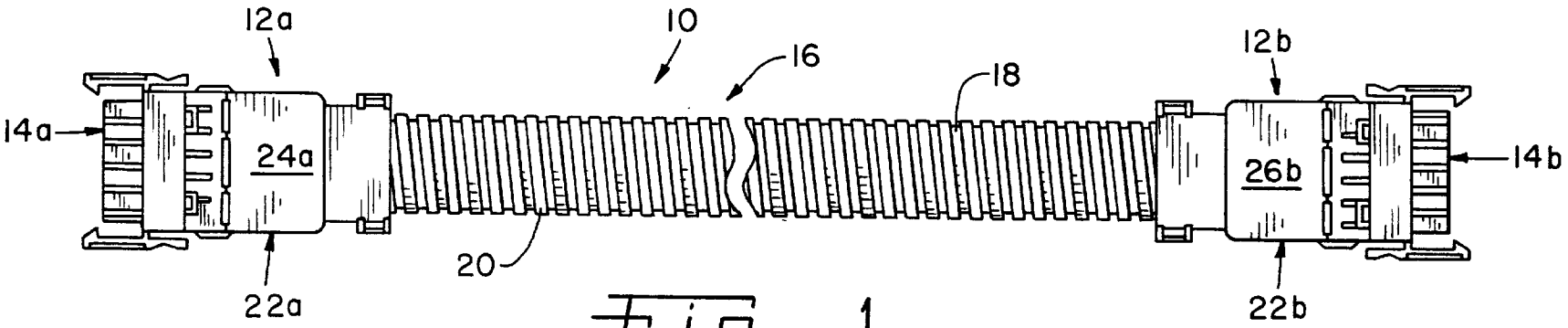
FIG. 1 is a top plan view of a jumper cable assembling terminating at both ends in a plug/connector assembly in accordance with the principles of the present invention.

Referring now to the drawings and, in particular, FIG. 1 there is shown jumper cable assembly 10 having plug or connector assembly 12*a* on one end of jumper conduit 16 and plug or connector assembly 12*b* on another end of jumper conduit 16. Plug assemblies 12*a* and 12*b* are identical but are separately denoted by "a" and "b" designations. Jumper conduit 16 is hollow and carries electrical conductors or lines 17 therein (FIG. 3) that can be used for a variety of purposes and as data, communications, power, and the like. Jumper conduit 16 may, as shown in FIG. 1, having single helical convolution 18 along with single helical land 20 which extends the longitudinal length thereof, or any other practical convolution/land arrangement. Also, jumper conduit 16 may be any length.

Figure 2:
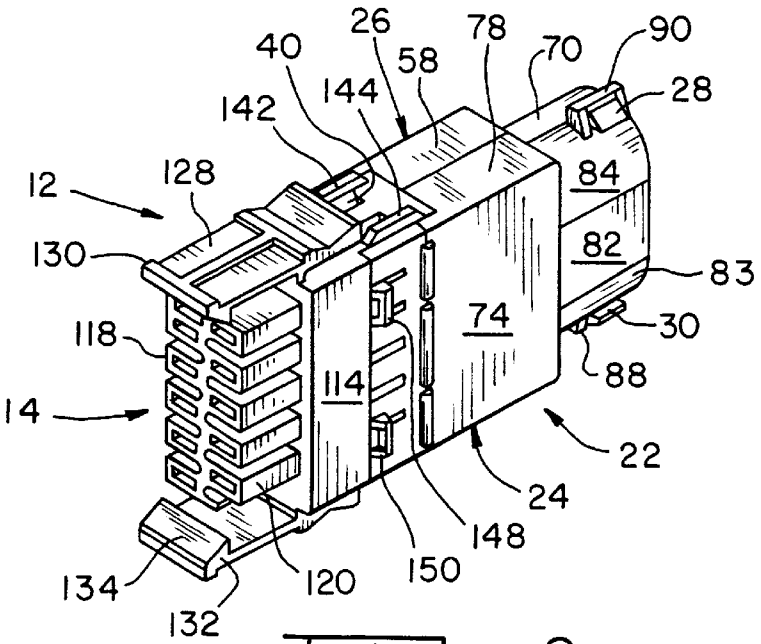
FIG. 2 is a perspective view of the present plug assembly.

Plug assemblies 12*a* and 12*b* each have respective bodies 22*a* and 22*b* releasably coupled with plugs 14*a* and 14*b* respectively. In FIG. 2, plug assembly 12 is depicted of which plug assemblies 12*a* and 12*b* of FIG. 1 correspond. Plug assembly 12 has body or housing 22 that defines a jumper cable and conduit retainer portion. Body 22 is fabricated from body portions 24 and 26. Body portions 24 and 26 are preferably formed as substantially complementary halves of body 22 as a whole, however, other housing or body part proportions can be used. Body portions 24 and 26 are preferably a plastic such as polycarbonate, however, other suitable materials may be used. Plug 14 of plug assembly 12 is adapted to be received onto body 22 and to a mating receptacle. A continuous extension 19 projects inwardly within body portions 24, 26. Extension 19 provides an abutment surface against which jumper conduit is abutted. Extension 19 extends inwardly from the inside diameter of conduit 16, thereby providing a guide for conductor 17 into conduit 16 and preventing wear to the insulation surrounding conductors 17 from contacting the metal end of conduit 16.

Figure 5:
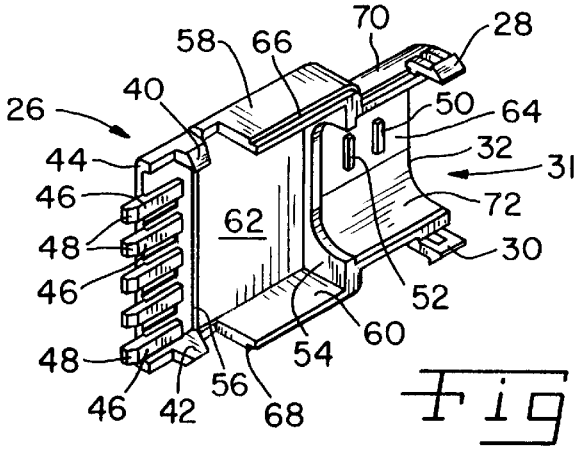
FIG. 5 is a perspective view of inside one portion of the body forming a portion of the plug assembly.

With additional reference to FIG. 5, body portion 26 of body 22 is shown. Body portion 26 is defined by wall or side 62 having two transverse side walls 58 and 60 and conduit reception end 31 defined by partial transverse wall 54. Conduit reception end 31 has wall or side 64 that extends essentially co-axial from side 62, curved side wall 70 that extends essentially co-axial from side wall 58, and curve side wall 72 that extends essentially co-axial from side wall 60. Hooked tabs 28 and 30 respectively project from curved side walls 70 and 72 proximate end 32. Extending from opposite side of side 62 in like manner to side wall 58 and 60 proximate end 44 are respective hooked tabs 40 and 42. Axially projecting from end 44 transverse to hooked tabs 40 and 42 are a plurality of prongs 46 each one of which has tapered end 48. Two projections or tabs 50 and 52 extend from the inside surface of side 64 that are spaced a distance apart corresponding to the distance of adjacent convolutions or rings 18 of jumper conduit 16. The length of tabs 50 and 52 preferably do not extend the width of inside surface of side 64 and are each offset a distance from end 32 thereof. In essence, tabs 50 and 52 provide starting threads in the case of a helical convolution style jumper conduit or axial stops in the case of a plurality of adjacent annular convolutions style jumper conduit. Additionally, side walls 58 and 70 have outside surface channel or trough 66 that preferably continuously extends the axial length of side walls 58 and 70, while side walls 60 and 72 have outside surface channel or trough 68 that preferably continuously extends the axial length of side walls 60 and 72.

Figure 6:
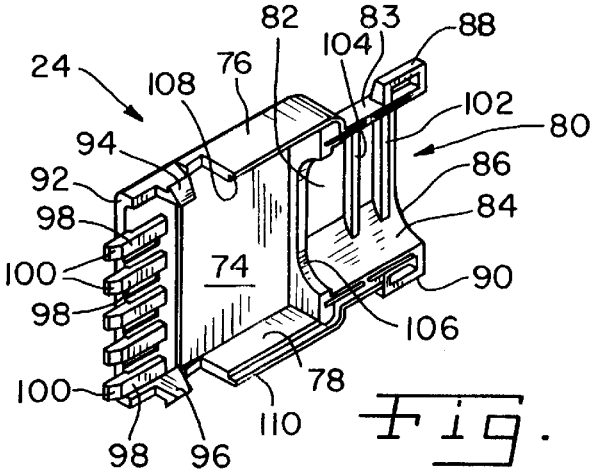
FIG. 6 is a perspective view of inside another portion of the body forming another portion of the plug assembly.

With additional reference to FIG. 6, body portion 24 of body 22 is shown. Body portion 24 is defined by wall or side 74 having two transverse side walls 76 and 78 and conduit reception end 80 defined by partial transverse wall 106. Conduit reception end 80 has wall or side 82 that extends essentially co-axial from side 74, curved side wall 82 that extends essentially co-axial from side wall 76, and curve side wall 84 that extends essentially co-axial from side wall 78. Projecting slots 88 and 90 are respectively disposed on curved side wall 82 and 84 proximate end 86. Extending from opposite side of face 62 in like manner to side wall 76 and 78 proximate end 92 are respective hooked tabs 94 and 96. Axially projecting from end 92 transverse to hooked tabs 94 and 96 are a plurality of prongs 98 each one of which has tapered end 100. Two projections or tabs 102 and 104 extend from the inside surface of side 82 that are spaced a distance apart corresponding to the distance of adjacent convolutions or rings 18 of jumper conduit 16. The length of tabs 102 and 104 preferably extend the width of inside surface of side 82 and are each offset a distance from end 86 thereof. In essence, tabs 102 and 104 provide threads in the case of a helical convolution style jumper conduit or axial stops in the case of a plurality of adjacent annular convolutions style jumper conduit. Additionally, side walls 76 and 83 have inside surface channel or trough 108 that preferably continuously extends the axial length of side walls 76 and 83, while side walls 78 and 84 have inside surface channel or trough 110 that preferably continuously extends the axial length of side walls 78 and 84.

Figure 3:
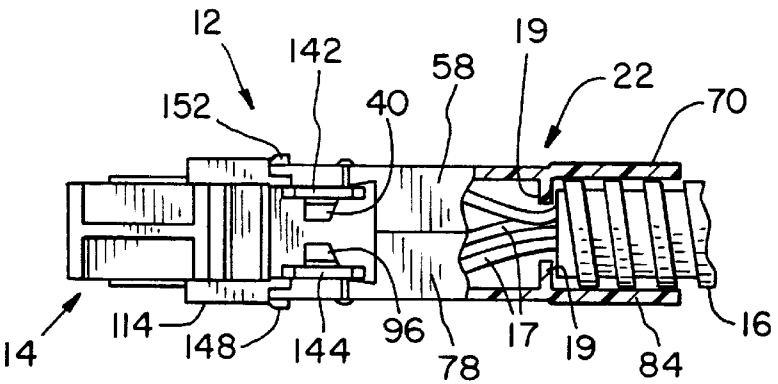
FIG. 3 is a side view of the present plug assembly.

With additional reference to FIGS. 2 and 3, the coupling of body portions 24 and 26 will be described. Initially, if jumper conduit 16 has a single helical convolution, then body portions 24 and 26 may be assembled independent of jumper conduit 16 so as to be threaded thereon after assembly. However, if jumper conduit 16 has a plurality of adjacent annular convolutions, then portions 24 and 26 should be assembled about end of jumper conduit 16, preferably with a jumper cable therein. Hooked tabs 28 and 30 of body portion 26 snap into slots 90 and 88 respectively of body portion 24. Outside channel 66 of side walls 58 and 70 cooperate with inside channel 110 of side walls 78 and 84, while outside channel 68 of side walls 60 and 72 cooperate with inside channel 108 of side walls 76 and 83 to interfit into each other. Body 22 is ready to receive plug 14.

Figure 4:
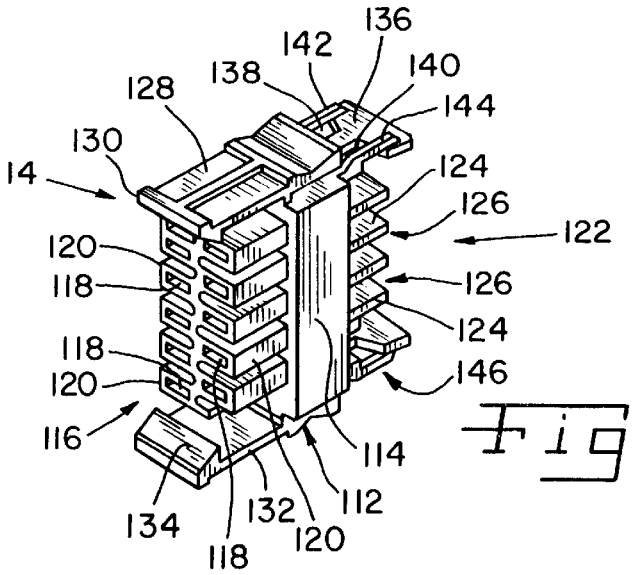
FIG. 4 is a perspective view of the plug head of the plug assembly.

FIG. 4 shows plug 14 that generically corresponds to plugs 14*a* and 14*b* of respective plug assemblies 12*a* and 12*b* of FIG. 1. Plug 14 is defined by plug shell or housing 112 that is preferably fabricated from a plastic such as polycarbonate. Plug shell 112 has middle section 114 with a plurality of conduits 118 therethrough each having an electrical terminal disposed therein. Conduits 118 are defined on one side of middle section 114 by projecting rectangular pipes 120. Pipes 120 are preferably spaced from one another thereby providing a keyed plug that allows coupling with a like keyed receptacle. When the plug is coupled with the receptacles, terminals within each conduit 118 of the plug are electrically coupled to terminals carried by the receptacle (not shown). Pipes 120 are shown arranged in two columns, but which is subject to variation. Extending from side 122 is a plurality of shelves 124 that defines a plurality of sockets 126 into which the terminals within conduits 118 coupled to the conductors/lines of the jumper cable.

Projecting from one side of middle section 114 and substantially co-axial with conduits 118 is arm 128 terminating in hooked tab 130. Arm 128 is movable relative to middle section 114 such that a spring arm is defines that allows hooked tab 130 to be displaced relative to middle section 114 by the application of pressure. The other end of middle section 114 includes arm 132 having hooked tab 134 that is structured and functions in like manner to arm 128 and hooked tab 130. Projecting from one side of middle section 114 and substantially co-axial with shelves 124 is ledge 136. Ledge 136 has oppositely disposed cutouts 138 and 140 that, along with spans 142 and 144 define receptions slots respectively. Side 146 of middle section 114 includes a ledge, cutouts, and spans that are structurally and functionally in like manner to ledge 136, cutouts 138 and 140, and spans 142 and 144.

With reference back to FIGS. 2 and 3, plug 14 is coupled to body 22 in the following manner. End 122 of plug 14 is received into prongs 46 and 98 of respective body portions 26 and 24 to laterally retain plug shell 114. Tabs 40 and 96 are received in slots 138 and 140 respectively of plug shell 114. Like tabs 42 and 94 are received in like slots (not seen) on the other end of plug shell 114. Plug 14 is thus snap fitted onto body 22. The conductors of the jumper cable may be connected at any time to the terminals of plug 14. Body portion 24 includes projection 148 and 150 on an outside surface of side 74, while body portion 26 also includes two like projections on an outside surface of side 62 of which only one such projection 152 is seen in FIG. 3, that act as stops for preventing further axial movement of plug 14 as plug 14 is received onto body 22. Body portions 24 and 26 may be attached together using any suitable attachment method, such as via sonic welding, heat staking, riveting, etc.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical cable assembly, comprising:

a body defined by a first body section and a second body section and having a conduit reception area and a plug reception area;

said first body section having a first given shape defining a first portion of said conduit reception area and a first portion of said plug reception area, said first portion of said conduit reception area having first tabs on an interior surface thereof;

said second body section having a second given shape defining a second portion of said conduit reception area and a second portion of said plug reception area, said second portion of said conduit reception area having second tabs on an interior surface thereof, said second given shape of said second body section mating with said first given shape of said first body section;

an electrical plug received within said plug reception area of said body; and a jumper conduit received within said conduit reception area and gripped by each of said first tabs and said second tabs, said first body section and said second body section including an inwardly projecting extension adjacent an end face of said jumper conduit, said extension providing an abutment surface, said abutment surface abutting said end face of said jumper conduit.

2. The electrical cable assembly of claim 1, wherein said first and second body sections have projections and an outside surface thereof adapted to abut surfaces of said plug upon said plug reaching an axial distance into said plug reception area.

3. The electrical cable assembly of claim 1, wherein at least one of said first tabs is adapted to be received in at least one convolution of a jumper conduit of the jumper assembly, and at least one of said second tabs is adapted to be received in at least one convolution of the jumper conduit.

4. The electrical cable assembly of claim 3, wherein said first and second tabs are angled to provide threads for receiving a jumper conduit having a helical convolution.

5. The electrical cable assembly of claim 1, wherein said first body section includes first guide prongs adapted to be received by said plug, and said second body section includes second guide prongs adapted to be received by said plug.

6. An electrical cable assembly, comprising:

a body defined by a first body section and a second body section and having a conduit reception area and a plug reception area;

said first body section having a first given shape defining a first portion of said conduit reception area and a first portion of said plug reception area, said first portion of said conduit reception area having first tabs on an interior surface thereof, said first body section including first hooked tabs on an end adjacent said first portion of said conduit reception area, and second hooked tabs on an end adjacent said first portion of said plug reception area;

said second body section having a second given shape defining a second portion of said conduit reception area and a second portion of said plug reception area, said second portion of said conduit reception area having second tabs on an interior surface thereof, said second given shape of said second body section mating with said first given shape of said first body section, said second body section including first slots on an end adjacent said second portion of said conduit reception area, and third hooked tabs on an end adjacent said second portion of said plug reception area;

an electrical plug received within said plug reception area of said body, said plug having slots on an upper and lower surface, said first hooked tabs adapted to be received in said first slots during coupling of the first and second body sections to retain said first and second body sections, and said second and third hooked tabs adapted to be received in said slots on an upper and lower surface of said plug to retain said plug onto said body; and a jumper conduit received within said conduit reception area and gripped by each of said first tabs and said second tabs.

7. A plug body for an electrical jumper cable assembly comprising:

a first body portion; and a second body portion adapted to be coupled to said first body portion and together therewith defining a jumper cable reception end and a plug reception end of said plug body;

said first body portion defined by a shell having a first section of the jumper cable reception end, a first section of the plug reception end, and a first connector on said first section of the jumper cable reception end; and a second body portion defined by a shell having a second section of the jumper cable reception end, a second section of the plug reception end, and a second connector on said second section of the jumper cable reception end and adapted to connect with said first connector of said first body portion, said first body section and said second body section including an inwardly projecting extension, said extension providing an abutment surface, said abutment surface being adapted to abut an end face of an adjacently positioned jumper conduit.

8. The plug body of claim 7, wherein said first and second body portions are fabricated from plastic.

9. The plug body of claim 8, wherein said plastic comprises a polycarbonate.

10. The plug body of claim 7, wherein said first connector comprises hooked tabs and said second connector comprises slots.

11. The plug body of claim 7, wherein said first body portion includes a third connector on said first section of the plug cable reception end, and said second body portion includes a fourth connector on said second section of the plug cable reception end, said third and fourth connectors adapted to couple with a plug receivable thereon.

12. The plug body of claim 7, wherein said first body portion includes first threads on an inside surface of said corresponding shell within said first section of the jumper cable reception end, and said second body portion includes second threads on an inside surface of said corresponding shell within said second section of the jumper cable reception end.

13. A plug assembly for an electrical jumper cable assembly having a jumper conduit adapted to carry a jumper cable and including a helical convolution therein, the plug assembly comprising:

a retainer body defined by first and second releasably coupled sections; and a plug releasably coupled to said retainer body;

said first section having threads on an interior portion thereof adapted to receive the helical convolution of the jumper conduit, a plurality of lateral stabilizers, and first and second connectors on opposite ends of said first section;

said second section having threads on an interior portion thereof adapted to receive the helical convolution of the jumper conduit, a plurality of lateral stabilizers, and third and fourth connectors on opposite end of said second section, said first connector of said first section and said third connector of said second section being one of a hooked tab and slot, said first section and said second section including an inwardly projecting extension, said extension providing an abutment surface, said abutment surface being adapted to abut an end face of the jumper conduit.

14. The plug assembly of claim 13, wherein said first connector comprises hooked tabs and said third connector comprises slots.

15. The plug assembly of claim 13, wherein said first and second sections include side wall having complementarily positioned lateral stability grooves.

16. The plug assembly of claim 13, wherein said plug includes coupling receptions slots adapted to releasably receive said second and fourth connectors.

* * * * *